United States Patent [19]

Ichikawa

[11] 3,980,018

[45] Sept. 14, 1976

[54] SPECIAL INTAGLIO PRINTING PROCESS FOR PREVENTING FORGERY OF SECURITIES

[75] Inventor: Ieyasu Ichikawa, Tokyo, Japan

[73] Assignee: Director General, Printing Bureau, Ministry of Finance, Tokyo, Japan

[22] Filed: July 11, 1973

[21] Appl. No.: 378,174

Related U.S. Application Data

[63] Continuation of Ser. No. 156,314, June 24, 1971, abandoned.

[30] Foreign Application Priority Data

July 3, 1970 Japan ..... 45-57988

[52] U.S. Cl. ..... 101/170; 101/401.1; 101/395

[51] Int. Cl.[2] ..... B41M 1/10; B41N 1/06

[58] Field of Search ..... 101/152, 170, 395, 401.1

[56] References Cited

UNITED STATES PATENTS

| | | | |
|---|---|---|---|
| 923,799 | 6/1909 | Saalburg | 101/170 |
| 2,029,103 | 1/1936 | Howey | 101/401.1 X |
| 2,063,614 | 12/1936 | McFarland | 101/401.1 X |
| 2,659,305 | 11/1953 | Giori | 101/155 X |
| 3,093,071 | 6/1963 | Taylor | 101/170 X |
| 3,304,861 | 2/1967 | Magid | 101/152 |
| 3,390,631 | 7/1968 | Koszuc | 101/170 |

FOREIGN PATENTS OR APPLICATIONS

| | | | |
|---|---|---|---|
| 641,543 | 5/1962 | Canada | 101/152 |
| 1,230,437 | 12/1966 | Germany | 101/152 |
| 1,806,263 | 6/1969 | Switzerland | 101/170 |
| 987,102 | 7/1961 | United Kingdom | 101/152 |

*Primary Examiner*—J. Reed Fisher
*Attorney, Agent, or Firm*—Larson, Taylor and Hinds

[57] ABSTRACT

An intaglio printing process utilizing a printing plate consisting of a precise engraving element which is adapted from a gravure printing plate. This printing plate is applied on the plate cylinder and printed with very stiff and viscous ink as used for engraving intaglio printing. Ink of various colors may be applied separately on different portions of the gravure plate surface by rollers. After inking, surplus ink can be wiped of by a wiping roller. Printing paper is introduced between the plate cylinder and impression cylinder for printing. off

2 Claims, 3 Drawing Figures

INVENTOR
IEYASU ICHIKAWA

Larson, Taylor and Hinds
ATTORNEYS

SPECIAL INTAGLIO PRINTING PROCESS FOR PREVENTING FORGERY OF SECURITIES

This is a continuation of application Ser. No. 156,314 filed June 24, 1971 now abandoned.

BACKGROUND OF THE INVENTION

This invention relates to intaglio printing process and, more particularly to a process for printing bank notes, postage stamps, bonds and securities, which are prevented from forgery or counterfeit and provided with novel appearance and rich gradations.

The intaglio printing process in accordance with the present invention employs a printing plate consisting of a precise engraving element which is adapted from a gravure printing plate. This printing plate applied on the plate cylinder is printed with very stiff and viscous ink as used for engraving intaglio printing. Ink of various colors may be applied separately on different portions of the gravure plate surface by rollers. After inking, surplus ink can be wiped off by wiping roller. Printing paper may be introduced between the plate cylinder and impression cylinder for printing.

Bank notes, postage stamps, bonds and securities can represent a huge value of money on one sheet of paper. Therefore, these securities must be printed with great care so that they will not be forged or counterfeited. To attain this object, considerable efforts have been made for the selection of paper quality, application of water mark, or special preparation of printing ink. In addition, very complicated patterns and lines, as well as various images and colors were used for displaying precise representations on the paper. Particular identification marks or numbers were also applied on the paper sheet to prevent forgery and counterfeiting.

For the manufacture of papers of the character as described above, it has been a usual practice to use the process of engraving intaglio rotary printing.

The printing plate used for this process has been provided with engraving by manually skilled craftsman with a highly artistic sense and furnished with geometrical patterns or designs produced by elaborate engraving machines paying due attention to the requisite of preventing forgery and they have made great endeavors even to obtain a single printing plate. In the course of the printing, it has been common to use ink of several kinds of color which is stiff and viscous to be applied on the surface of the printing plate. Such printing process provides an artistic and effective printed paper for the prevention of forgery by dint of variation of width and depth of engraving lines on the printing plate. Due to representation by engraved drawing lines, however, it had a disadvantage that the printed image often became quite monotonous. Thus, photographically fine representation or continuous gradations were not satisfactorily obtained by this process.

Among these securities, the postage stamp has mostly used gravure printing. By use of several kinds of gravure plates and colors, gravure printing could offer a large number and varied kinds of fine postage stamps rapidly. According to this gravure printing, the printing was made by use of a usual gravure printing machine. The printing plate for this purpose was normally formed of small recesses or cells sectioned by gravure screens and having different depths on the printing plate. Printing ink could fill in these cells and produce fine gradations of colors in highlight or shadow continuously on the printed paper. This ink is generally termed as gravure ink. It is soft and fluid, containing much evaporating solvent and is low in viscosity. Thus, the gravure ink was applied to the cells of the printing plate. In a subsequent step of the process, the surplus ink which remained on the gravure printing plate was scraped off by a doctor blade.

Since the gravure printing process uses a very fluid ink which readily flows downwards, it is impossible to use for one-plate multiple color printing. The fluid ink then used is so soft as to flow freely downwards because it contains much evaporating solvent. It is caused by this fluidity that a phenomenon appears as described below in the cells of different depth on the gravure plate. This gravure plate is provided with a number of cells as above described. These cells impart fine gradations to the printed paper by variation of depth for each cell. In the gradations, deep cells represent dark portions in the printed paper. The printing ink filled in the deep cells flows over the cells and produces waveform patterns on the printed paper surface. This is usually called "mottling" phenomenon. The waveform patterns produced by the "mottling" phenomenon make the printed surface quite awkward in appearance. Highlight portions of the printed image are printed by shallow cells of the plate. The ink of these portions is over-scraped off or they are not sufficiently filled with ink so that the printed surface of paper will have uninked portions remained on the printed paper. This phenomenon is called "speckle." Both the abovementioned phenomena would cause damage to the appearance of the printed paper. Despite endeavors made for improvement of the process, these drawbacks have not yet been overcome to the advantage of the gravure printing. Such drawbacks are particularly apparent in the gravure printing of postage stamps which particularly requires beauty and a good quality product. Additionally, this gravure printing is not available for preventing forgery.

There is also a high grade printing process such as the overlapping printing process which combines the advantages of described gravure printing and the engraving printing. However, this printing process is technically hard because the two processes must be separately undertaken. Therefore, full conformity of printing or perfect register of the printed product are not obtained.

It is a primary object of the invention to provide an improved process of intaglio printing which can serve for the prevention of forgery substantially for any kind of securities. The process for printing in accordance with the present invention comprises steps of producing patterns, portraits, or drawings through fine and delicate engraving on the gravure plate, imparting various colors on the different portions of the gravure plate with desired ink, whereby one-plate multicolor printing which is unable to obtained by conventional gravure printing can be readily attained on this gravure plate. The process makes it possible to print any kind of bank notes, postage stamps, bonds and securities being fully prevented from forgery or counterfeiting furnished.

Another object of the invention is to produce a useful printed paper which is free from "mottling" or "speackle" by use of the gravure plate.

Another object of the invention is to obtain a printed paper with photographically rich gradations that cannot be singly achieved by prior art engraving intaglio printing.

It is a further object of the invention to obtain a printed paper which has printed surfaces in perfect register not heretofore provided by overlapping printing in combination of gravure printing and intaglio printing.

BRIEF DESCRIPTION OF THE INVENTION

These and other objects of the invention can be achieved by means of the printing plate of the present invention, which consists of an element plate having fine engravings on the gravure plate. The element plate is positioned on the plate cylinder, and very viscous or rather stiff ink as used for the engraving intaglio printing is applied by an inking roller onto the element plate as supplied from inkers containing ink of different colors. The surplus ink is wiped off by a wiping roller, and a printing paper is applied between the impression cylinder and the plate cylinder. The drawbacks such as hitherto encountered in the process of printing of securities can be eliminated and a novel and useful product can be obtained serving for the prevention of forgery or counterfeiting.

An example of a process of printing according to the invention will be described below in more detail.

DETAILED DESCRIPTION

There follows a detailed description of a preferred embodiment of the invention, together with accompanying drawings. However, it is to be understood that the detailed description and accompanying drawings are provided solely for the purpose of illustrating a preferred embodiment and that the invention is capable of numerous modifications and variations apparent to those skilled in the art without departing from the spirit and scope of the invention.

Figure 1:
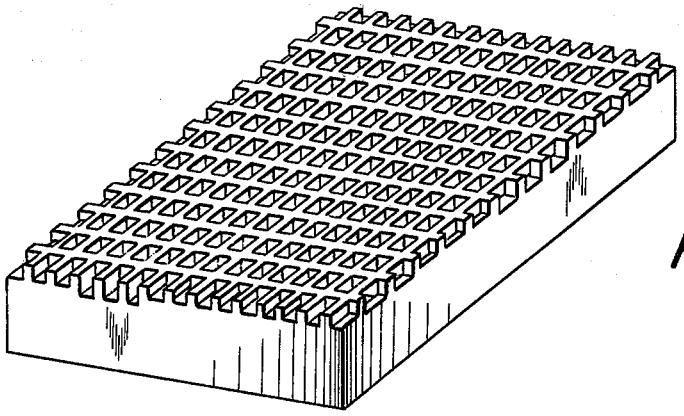
FIG. 1 is a diagrammatic view of a gravure system gradation printing plate used in gradation intaglio printing.
Figure 2:
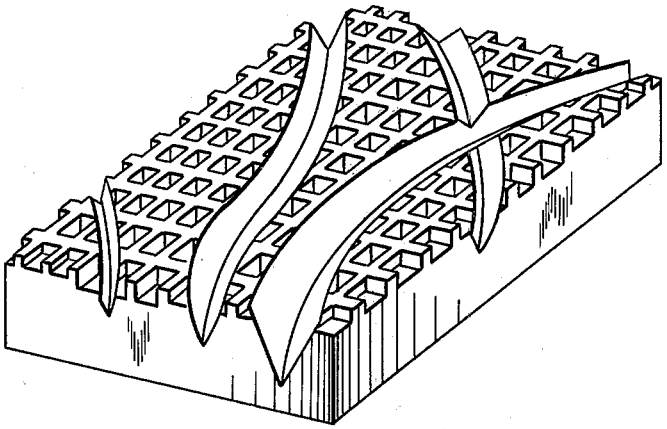
FIG. 2 is a diagrammatic view of a gradation intaglio printing plate according to the invention consisting of a gravure system gradation printing plate added with engraving drawing lines.
Figure 3:
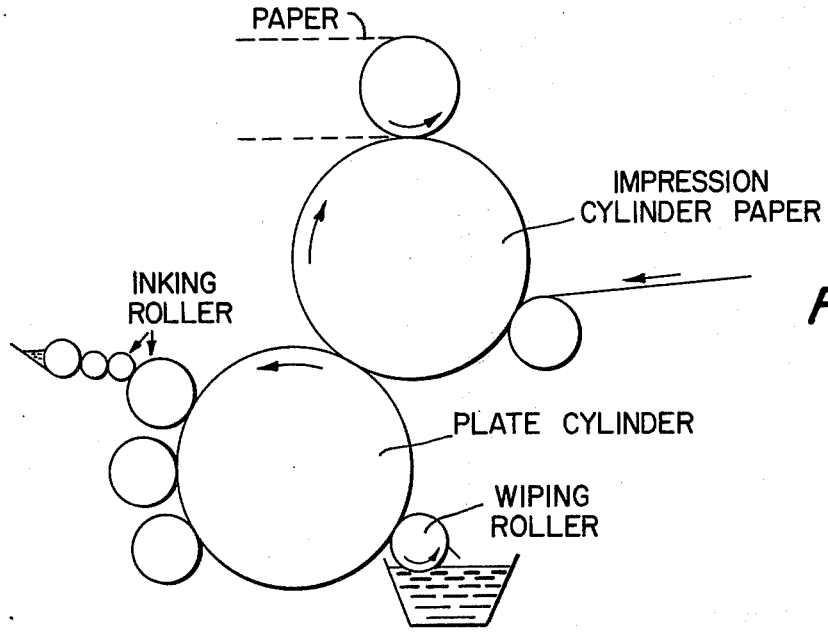
FIG. 3 is a diagrammatic view of mechanism of an intaglio printing machine adapted for printing according to the invention.

The intaglio printing process of the present invention provides a printing plate having essential representation and gradations imparted by an assembly of fine cell components each having different depth same as in the gravure plate, in which preferably complicated figures, letters and patterns may be engraved by manual or mechanical means to thereby attain effective prevention of forgery. Manually engraved by craftsman or mechanically by elaborate machines, the engraved drawing lines are represented deep or shallow on the plate surface so that one cannot copy for forgery or counterfeiting.

The printing plate thus prepared is then attached on the plate cylinder.

The ink is supplied through several inking rollers from inkers. The inkers are disposed around the plate cylinder and can contain various colors of ink.

To meet the object of the invention, the ink may preferably be high in viscosity as normally used for the engraving intaglio printing, differing from the soft and fluid ink which contains much evaporating solvent as used to ordinary gravure printing.

The roller is made of rubber or plastic of excellent quality. On the roller is provided relief patterns composed of variously defined sections. The ink applied on the relief portions of the each roller would readily transfer to the desired surface of the plate. Thus, the ink is applied on the one plate with various coloured inks.

For wiping off the surplus ink, the wiping roller is turned in rotation in contact with the plate surface opposite to the rotation of the plate cylinder.

After preparation is made for printing, the impression cylinder is rotated in contact with plate cylinder and the printing paper is passed between the impression cylinder and plate cylinder so as to effect printing by gravure plate having engravings of the invention. The printing paper is supplied continuously and after printing it is discharged through a discharging path.

The printed paper obtained by the printing process of the present invention therefore provides various patterns, which are inked with stiff ink in several kinds of color. The ink fills up the cells and the engraved lines of desired portion of the plate with each desired several color. If preferred, printing may be effected only with ink of one kind, whereupon variation of depths of cells and engraving lines would cause complicated change in the thickness of ink applied on the paper, consequent on that the printed paper is imparted the variable tone and attractive color.

These are the effects as specifically obtained from the process of the invention which supersedes conventional gravure printing which is incapable of "Sammel druck" by the gravure printing.

According to the process of this invention a conventional gravure plate may be used as the printing plate, also.

Thus, the printing process according to this invention is adequate for the printing of papers pertinently required for the prevention from forgery in the production of bank notes, postage stamps, bonds and securities.

What I claim is:

1. An intaglio printing process for preventing forgery or counterfeiting of securities or the like comprising: providing a gravure printing plate having a grid pattern representing an original design and made up of a plurality of small discrete recesses on the plate surface, said recesses varying in depth for reproducing fine continuous gradations of color, highlight or shadow of the original design on a surface printed by the inked plate, said plate also having elongate engraved grooves cut into the plate surface and extending across a plurality of said gravure recesses, said engraving grooves varying in depth and width and representing a complex pattern for preventing forgery or counterfeiting; positioning said printing plate on a printing plate cylinder; inking said printing plate with ink having a viscosity of a normal intaglio engraving printing ink; wiping off surplus ink from the plate surface; feeding a sheet between the inked printing plate and an impression cylinder in contact with said printing plate cylinder to obtain on said sheet a printed reproduction of said original design including said complex pattern for preventing forgery or counterfeiting.

2. An intaglio printing process according to claim 1 wherein various portions of the printing plate are inked with different color inks.

* * * * *